US011421894B2

(12) United States Patent
Paller

(10) Patent No.: US 11,421,894 B2
(45) Date of Patent: Aug. 23, 2022

(54) SPILL GUARD FOR A GAS OVEN BURNER

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 58 days.

(21) Appl. No.: 16/927,329

(22) Filed: Jul. 13, 2020

(65) Prior Publication Data

US 2022/0010971 A1 Jan. 13, 2022

(51) Int. Cl.

| | |
|---|---|
| ***F24C 3/08*** | (2006.01) |
| ***F24C 15/36*** | (2006.01) |
| *F23D 14/10* | (2006.01) |
| *F24C 3/00* | (2006.01) |

(52) U.S. Cl.

CPC ..... *F24C 15/36* (2013.01); *F24C 3/087* (2013.01); *F23D 14/10* (2013.01); *F24C 3/008* (2013.01)

(58) Field of Classification Search

CPC ..... F24C 15/36; F24C 3/087; F24C 3/008; F23D 14/10; F23D 14/70; A47J 37/0652

See application file for complete search history.

(56) References Cited

U.S. PATENT DOCUMENTS 1,344,136 A * 6/1920 Kobe ..... F24C 3/027 126/39 J
1,392,482 A * 10/1921 Cole ..... F24B 1/003 126/17
2,160,764 A * 5/1939 Taylor ..... F24C 15/32 126/273 R
2,298,103 A * 10/1942 Broome ..... F24C 1/04 126/39 C
2,664,877 A * 1/1954 Mclaughlin ..... F24C 3/027 126/39 R
3,322,112 A * 5/1967 Huff ..... F24C 3/087 126/41 R
3,386,431 A * 6/1968 Branson ..... F23D 14/10 126/39 R
3,540,258 A * 11/1970 Branson ..... F23D 14/10 72/324
3,667,447 A * 6/1972 Toth ..... F24C 14/025 126/21 A (Continued)

FOREIGN PATENT DOCUMENTS

CN 207236671 U 4/2018
JP 2017077392 A 4/2017

(Continued)

*Primary Examiner* — Jorge A Pereiro

(74) *Attorney, Agent, or Firm* — Dority & Manning, P.A.

(57) ABSTRACT

An oven appliance includes a cooking chamber defined at least in part by a bottom wall having an outlet port defined therein, wherein the outlet port defines a virtual boundary projected in the vertical direction, a burner positioned below the bottom wall proximate the outlet port and outside of the virtual boundary of the outlet port, and a burner shield. The burner shield includes a cover portion positioned directly over the burner, and a first extension having a first edge connected to the cover portion and a second edge opposite the first edge, wherein the first extension extends toward the outlet port.

17 Claims, 5 Drawing Sheets

(56) References Cited

U.S. PATENT DOCUMENTS 3,783,854 A * 1/1974 Hurko ..... F24C 14/025 126/21 R
4,334,137 A * 6/1982 Takagi ..... F24C 15/322 219/400
4,336,789 A * 6/1982 Ogawa ..... F24C 15/322 126/21 A
4,416,249 A * 11/1983 Reynolds ..... A47J 37/06 126/41 R
4,718,400 A * 1/1988 Lotz ..... F24C 15/18 126/19 R
5,038,748 A * 8/1991 Lockwood ..... F24C 14/025 126/19 R
5,205,273 A * 4/1993 Sparks ..... F24C 15/322 126/21 A
9,970,655 B2 5/2018 Paller
2004/0177842 A1* 9/2004 Larsen ..... F24C 3/087 126/41 R
2006/0194162 A1* 8/2006 Pompe ..... F23D 14/20 431/354
2012/0037147 A1* 2/2012 Kim ..... F24C 3/087 126/39 R
2014/0196712 A1* 7/2014 Cadima ..... F23D 14/10 126/41 R
2015/0101592 A1* 4/2015 Cadima ..... F24C 3/087 126/41 R
2018/0356101 A1* 12/2018 Lee ..... A47J 37/0682
2020/0200396 A1* 6/2020 Kim ..... F24C 15/02
2020/0309380 A1* 10/2020 Martin ..... F28D 7/16

FOREIGN PATENT DOCUMENTS

KR 20030086081 A 11/2003
WO WO-2011073167 A1 * 6/2011 ..... F24C 3/087

* cited by examiner

SPILL GUARD FOR A GAS OVEN BURNER

FIELD OF THE INVENTION

The present subject matter relates generally to gas ovens, and more particularly to direct cavity heating gas ovens and spill guards for burners in gas ovens.

BACKGROUND OF THE INVENTION

Conventional ovens are household appliances used to cook or reheat food items or cooking utensils, such as baking dishes or pans. A user may place a food item or cooking utensil into an oven cavity to be heated. For example, certain oven appliances include heating elements such as an electrical heating element or a gas burner. The food item or cooking utensil may be heated by conduction, convection, or radiation.

Conventional ovens having a gas burner as a heat source exhibit certain drawbacks. For example, a gas burner is typically placed at the bottom of the oven cavity (e.g., beneath a lower wall or bottom plate of a cooking chamber). As such, outlet ports on the gas burner are susceptible to clogging from juices or other food stuffs falling or splashing onto the gas burner. For another example, to avoid having food stuffs contacting the gas burner, the gas burner may be placed below a bottom panel and away from an outlet hole defined in the bottom panel through which flames and/or heat may enter the cooking chamber.

However, a considerable amount of heating power and energy is wasted or absorbed by the bottom panel when the gas burner is placed far away from the outlet hole. Moreover, simply moving the gas burner closer to the outlet hole increases the risk of clogging or contamination. Accordingly, a gas burner oven with features that obviate one or more of the aforementioned drawbacks would be useful. In particular, a gas burner oven incorporating a burner shield would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cooking chamber defined at least in part by a bottom wall having an outlet port defined therein, wherein the outlet port defines a virtual boundary projected in the vertical direction; a burner positioned below the bottom wall proximate the outlet port and outside of the virtual boundary of the outlet port; and a burner shield. The burner shield may include a cover portion positioned directly over the burner; and a first extension having a first edge connected to the cover portion and a second edge opposite the first edge, wherein the first extension extends toward the outlet port.

In another exemplary aspect of the present disclosure, a burner assembly is disclosed. The burner assembly may include a burner positioned below the bottom wall proximate the outlet port and outside of a virtual boundary of the outlet port that extends in a vertical direction; and a burner shield. The burner shield may include a cover portion positioned directly over the burner; and a first extension having a first edge connected to the cover portion and a second edge opposite the first edge, wherein the first extension extends toward the outlet port These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
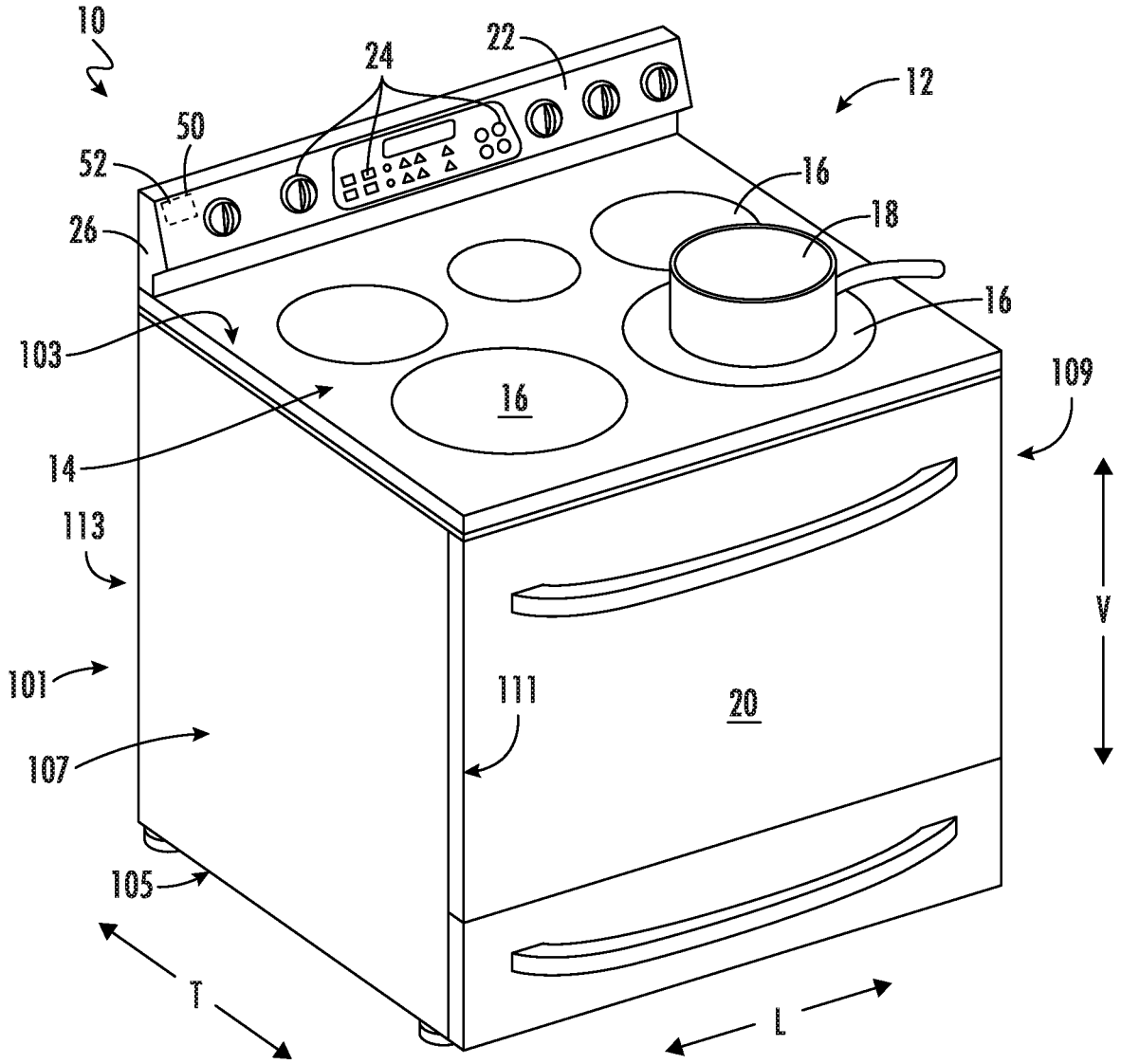
FIG. 1 provides a perspective view of an oven range according to exemplary embodiments of the present disclosure.
Figure 2:
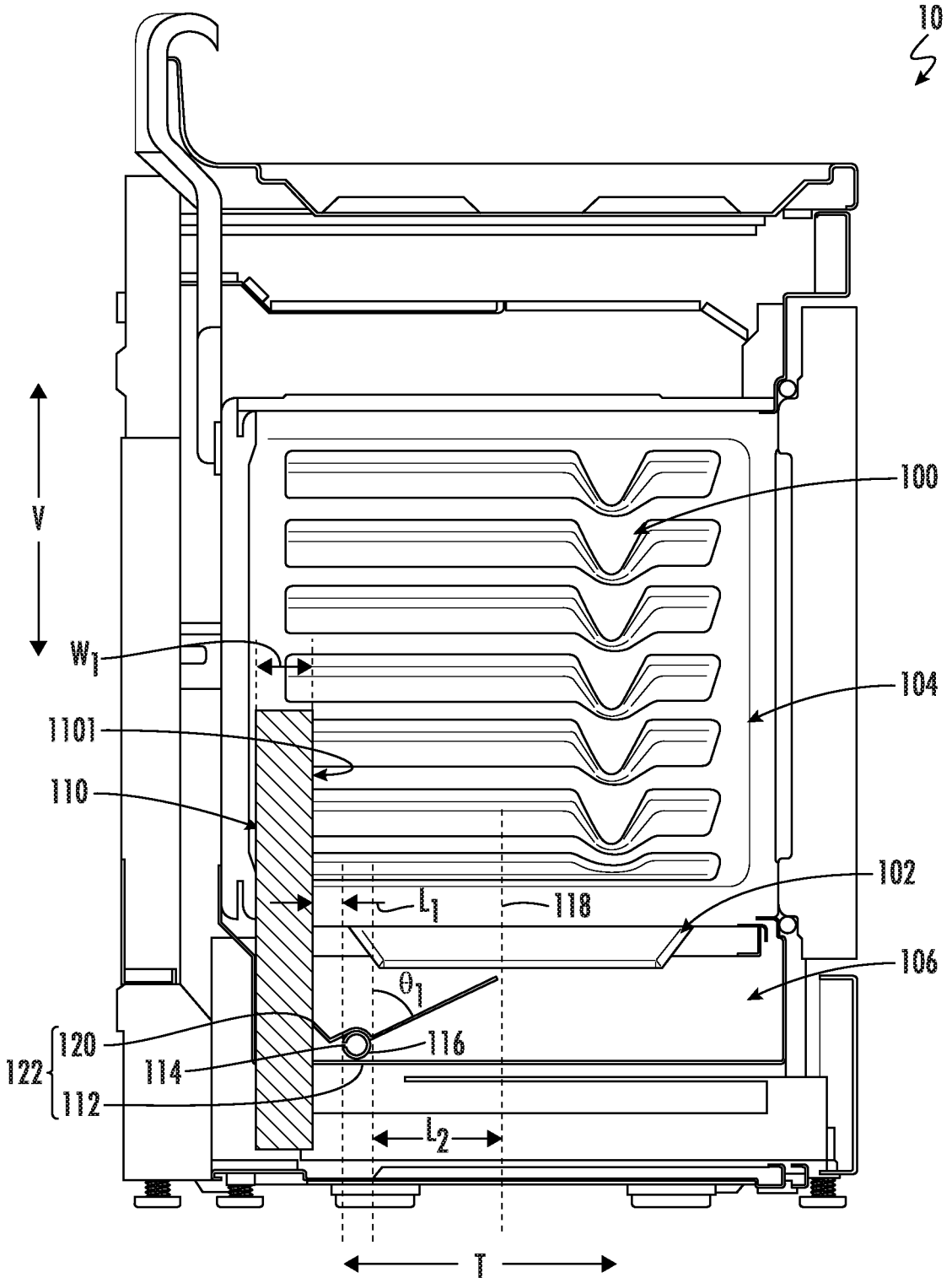
FIG. 2 provides a side cut-away view of the exemplary oven range of FIG. 1.
Figure 3:
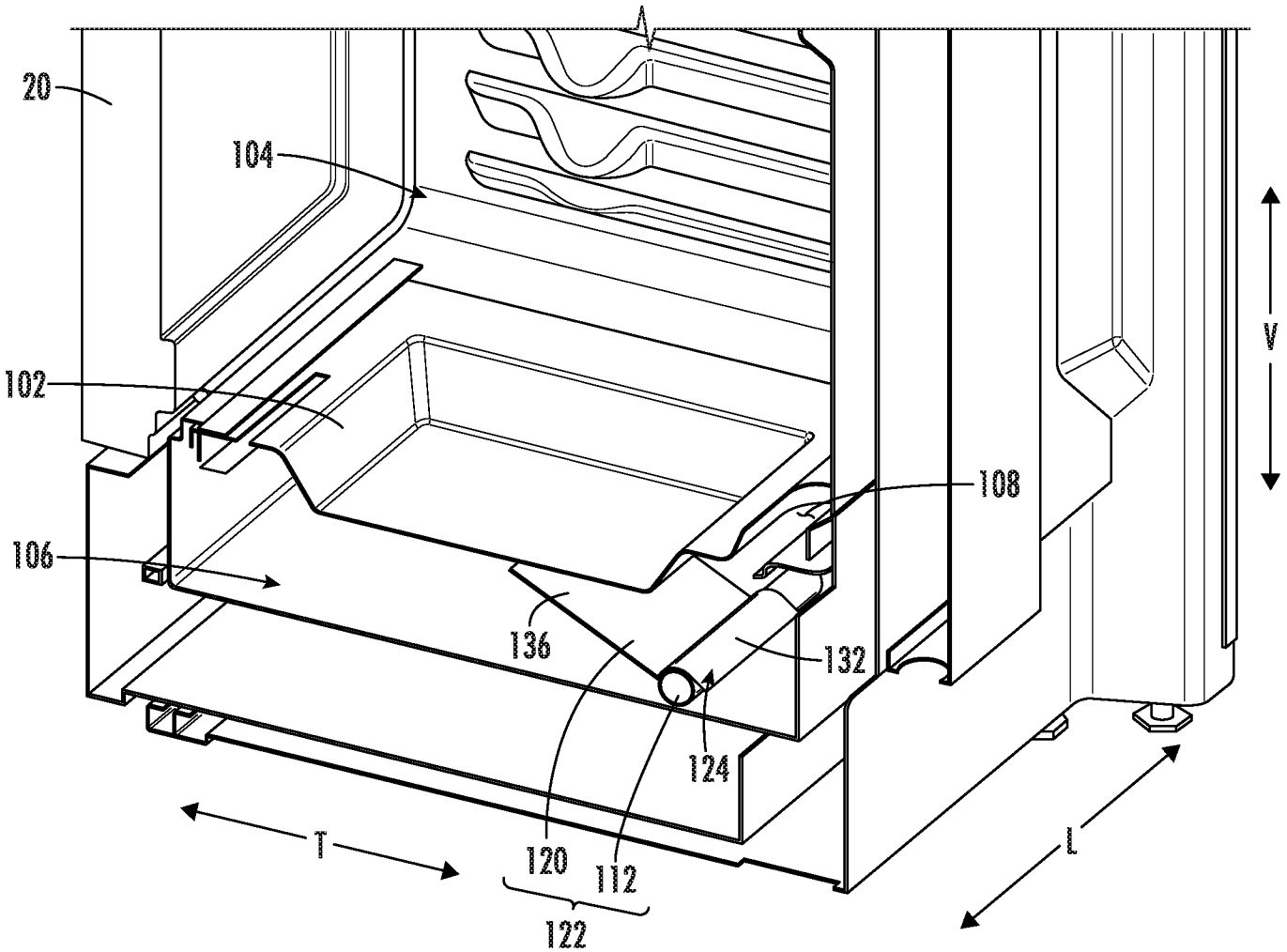
FIG. 3 provides a cut-away perspective view of a cooking chamber of the exemplary oven range of FIG. 1.
Figure 4:
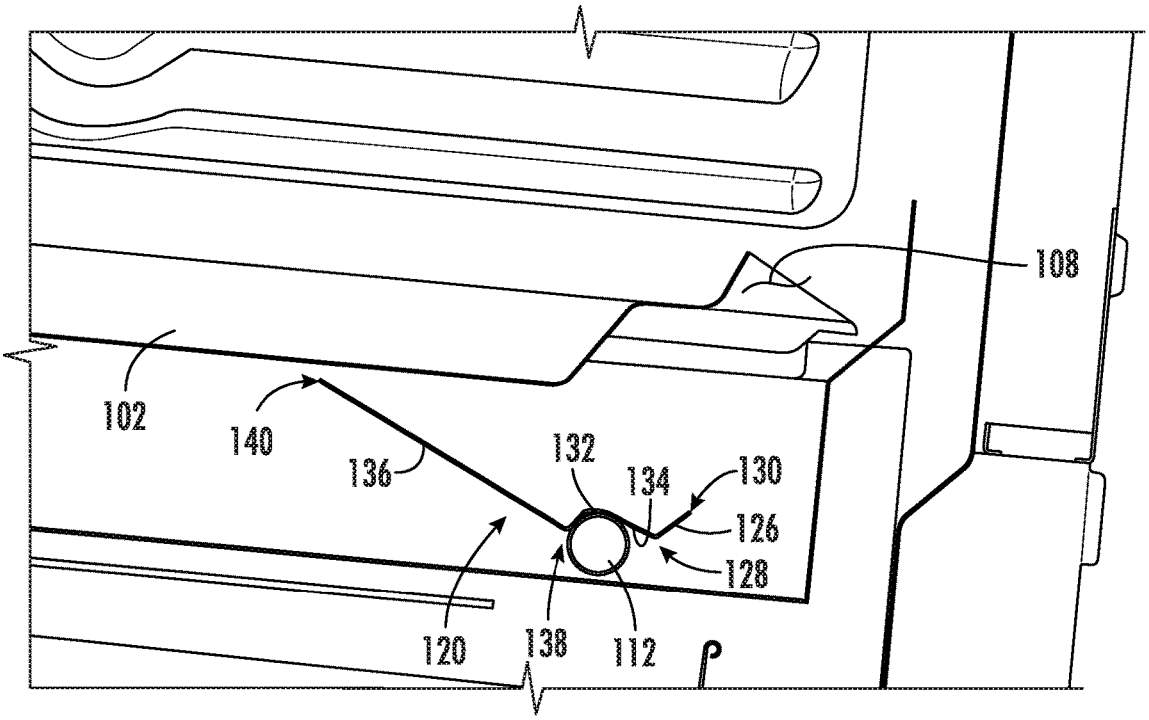
FIG. 4 provides a side cut-away view of the cooking chamber of the exemplary oven range of FIG. 1 showing a burner shield.
Figure 5:
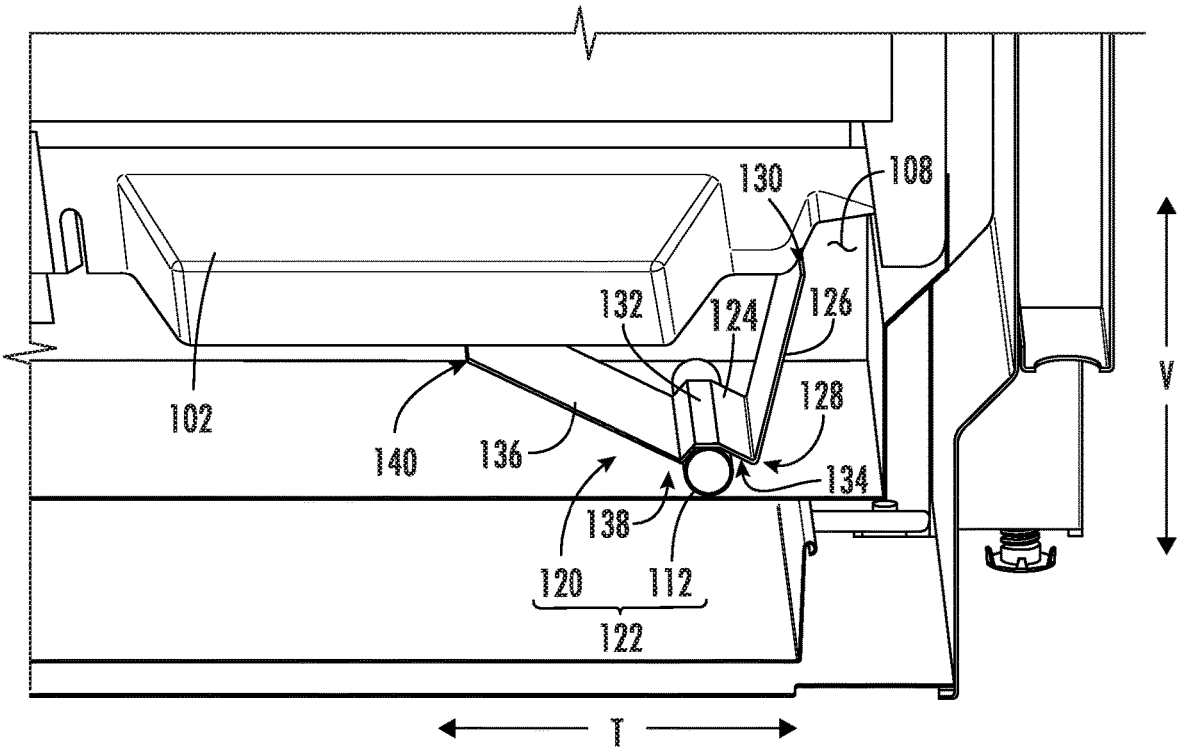
FIG. 5 provides a cut-away perspective view of an embodiment of the burner shield of the exemplary oven range of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a range appliance, or oven range 10, including a cooktop 12. Oven range 10 is provided by way of example only and is not intended to limit the present subject matter to the arrangement shown in FIG. 1. Thus, the present subject matter may be used with other range 10 and/or cooktop 12 configurations, e.g., double oven range appliances. As illustrated, oven range 10 generally defines a vertical direction V, a lateral direction L, and a transverse direction T, each of which is mutually perpendicular, such that an orthogonal coordinate system is generally defined. Oven range 10 includes a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 includes a plurality of heating elements 16. For the embodiment depicted, the cooktop 12 includes five heating elements 16 spaced along cooking surface 14. The heating elements 16 are generally electric heating elements and are positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16, for example, the cooktop appliance 12 may be an open coil cooktop with the heating elements 16 positioned on or above surface 14. Additionally, in other embodiments, the cooktop appliance 12 may include any other suitable type of heating element 16, such as an induction heating element. Each of the heating elements 16 may be the same type of heating element 16, or cooktop appliance 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber 104 (described below) of range appliance 10, e.g., for cooking or baking of food items therein. A control panel 22 having controls 24 permits a user to make selections for cooking of food items. Although shown on a backsplash or back panel 26 of range appliance 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16 and the cooking chamber. The selected temperature or heat output of heating element 16 affects the heat transferred to cooking utensil 18 placed on heating element 16.

The cooktop appliance 12 includes a control system 50 for controlling one or more of the plurality of heating elements 16 and the cooking chamber. Specifically, the control system 50 may include a controller 52 operably connected to the control panel 22 and controls 24. The controller 52 may be operably connected to each of the plurality of heating elements 16 for controlling a power supply to each of the plurality of heating elements 16 in response to one or more user inputs received through the control panel 22 and controls 24.

Referring generally to FIGS. 2 through 6, oven range 10 may define an oven cavity 100. Oven cavity 100 may be defined at least in part by a bottom wall 102. The bottom wall 102 may divide oven cavity 100 into a cooking chamber 104 and a burner housing 106. In some embodiments, the burner housing 106 is provided below the cooking chamber 104 (e.g., under the bottom wall 102). The bottom wall may include an outlet port 108 defined therein. In some embodiments, the outlet port 108 is provided at a rear of the bottom wall 102 (e.g., proximate a rear of the oven range 10 opposite the door 20). The outlet port 108 may allow fluid communication between the cooking chamber 104 and the burner housing 106 through the bottom wall 102. For example, air heated in the burner housing 106 may pass into the cooking chamber 104 via the outlet port 108.

Although a single outlet port 108 is illustrated and described herein, it should be appreciated that any suitable, number, size, position, and configuration of outlet ports could be used while remaining within the scope of the present subject matter. For example, in some embodiments, multiple outlet ports 108 may be defined in the bottom wall 102. In these embodiments, the outlet ports 108 may be spaced apart from each other in the lateral direction L.

The outlet port 108 may define a virtual boundary 110 projected in the vertical direction V. For example, a cross-section of the virtual boundary 110 in a horizontal plane defined in the lateral direction L and the transverse direction T may be a perimeter of the outlet port 108. As such, the virtual boundary 110 may resemble a three-dimensional projection of the outlet port 108 in the vertical direction V.

The oven range 10 may include a burner 112. The burner 112 may be provided beneath the bottom wall 102 (e.g., within the burner housing). The burner 112 may be a gas burner (e.g., a burner using a gas fuel to create a flame to produce heat). The burner 112 may have any suitable shape, for example, cylindrical, pancake (e.g., flat), square, etc. The burner 112 may be oriented such that a longitudinal axis of the burner 112 extends in the lateral direction L. As such, the burner 112 may define a first end proximate a first lateral side of the oven cavity and a second end opposite the first end and proximate a second lateral side of the oven cavity. Further, the burner 112 may be provided in plurality under the bottom wall 102. For example, two burners 112 may be provided and spaced apart from each other in the lateral direction L. For another example, two burners 112 may be provided and spaced apart from each other in the transverse direction T (e.g., a first burner at a rear of the oven cavity 100 and a second burner at a front of the oven cavity).

The burner 112 may include a plurality of first gas ports 114. The plurality of first gas ports 114 may be defined in an outer surface of the burner 112. In one example, when the burner 112 is a cylindrical burner, the first gas ports 114 are defined in the circumferential surface of the burner 112. In another example, when the burner 112 is a pancake burner, the first gas ports 114 are defined in a side panel of the burner 112. According to an exemplary embodiment, first gas ports may face toward outlet port 108 or may otherwise direct a flame and/or heated gas toward outlet port 108. For example, according to the illustrated embodiment, the first gas ports 114 may face substantially toward the rear of the oven cavity 100, e.g., such that outlet port 108 is positioned between burner 112 and a rear wall of the cooking chamber 104 along the transverse direction T.

The burner 112 may further include a plurality of second gas ports 116. The plurality of second gas ports 116 may be defined in an outer surface of the burner 112. In one example, when the burner 112 is a cylindrical burner, the second gas ports 116 are defined in the circumferential surface of the burner 112. In another example, when the burner 112 is a pancake burner, the second gas ports 116 are defined in a side panel of the burner 112. The second gas ports 116 may face substantially toward the front of the oven cavity 100 (e.g., toward the door 20) and away from outlet port 108. The plurality of second gas ports 116 may be fewer in number than the plurality of first gas ports 114 (e.g., there may be a fewer total number of second gas ports 116 than first gas ports 114). Additionally or alternatively, a size of each of the plurality of second gas ports 116 may be smaller than a size of each of the plurality of first gas ports 114. The size of each of the first gas ports 114 and second gas ports 116 may be measured by gas port area (e.g., a cross-sectional area of the gas port).

The burner 112 may be proximate the outlet port 108. In some embodiments, the burner 112 is outside of the virtual boundary 110. For example, the burner 112 may be located in front of the virtual boundary 110 in the transverse direction T (e.g., between the virtual boundary 110 and the door 20). In some embodiments, the burner 112 is provided behind a vertical center line 118 of the bottom wall 102 in the transverse direction T. For example, the burner 112 may be located between a front plane 1101 of the virtual boundary 110 and the vertical center line 118 of the bottom wall 102. The burner 112 may be located closer to the virtual boundary 110 than to the vertical center line 118 of the bottom wall 102 in the transverse direction T. Accordingly, the burner 112 may be located closer to the outlet port 108 than to the vertical center line 118 of the bottom wall 102 in the transverse direction T. For example, a horizontal distance $L_1$ between the plurality of first gas ports 114 and the front plane 1101 of the virtual boundary 110 in the transverse direction T may be 1% to 20% of a horizontal distance $L_2$ between the plurality of second gas ports 116 and the vertical center line 118 of the bottom wall 102. For another example, the horizontal distance $L_1$ between the plurality of first gas ports 114 and the front plane 1101 of the virtual boundary 110 in the transverse direction T is 10% of the horizontal distance $L_2$ between the plurality of second gas ports 116 and the vertical center line 118 of the bottom wall 102. For another example, the horizontal distance $L_1$ between the plurality of first gas ports 114 and the front plane 1101 of the virtual boundary 110 in the transverse direction T is shorter than a width $W_1$ of the virtual boundary 110 in the transverse direction T.

The range oven 10 may further include a burner shield 120. The burner shield 120 and the burner 112 may collectively be referred to as a burner assembly 122. The burner shield 120 may be provided beneath the bottom wall 102 (e.g., within the burner housing 106). The burner shield may be provided above the burner 112. For example, the burner shield 120 is located between the burner 112 and the bottom wall 102. The burner shield 120 may have a length in the lateral direction L and a width in the transverse direction T. The length of the burner shield 120 may be commensurate with a length of the outlet port 108 in the lateral direction. The width of the burner shield 120 may be greater than a width of the burner 112 in the transverse direction T (e.g., a diameter of the burner 112).

The burner shield 120 may include a cover portion 124 positioned directly over the burner 112 and a first extension 126 having a first edge 128 connected to the cover portion 124 and a second edge 130 opposite the first edge 128. The cover portion 124 may be positioned over the burner 112 in the vertical direction V. The cover portion 124 may be curved. In detail, a convex side 132 of the cover portion 124 may face the bottom wall 102, and a convex side 124 of the cover portion 124 may face the burner 112. As such, the burner 112 may partially accommodated within the cover portion 124.

Figure 6:
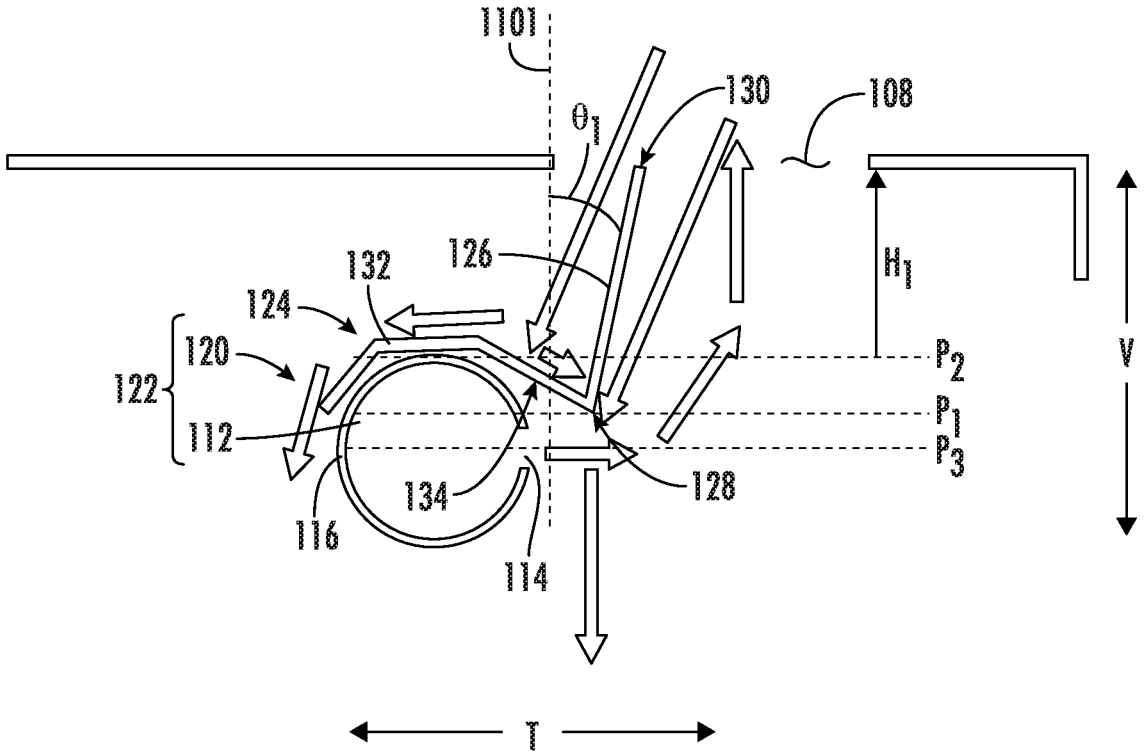
FIG. 6 provides a schematic view of an embodiment of a burner shield of the exemplary oven range of FIG. 1.

As best shown in FIG. 6, a junction between the first edge 128 of the first extension 126 and the cover portion 124 may be located in a first horizontal plane $P_1$. A top of the burner 112 may be located in a second horizontal plane $P_2$. The plurality of first gas ports 114 may be located in a third horizontal plane $P_3$. The first horizontal plane $P_1$ may be between the second horizontal plane $P_2$ and the third horizontal plane $P_3$ in the vertical direction V. As such, the junction between the first extension 126 and the cover portion 124 may be below a top of the burner 112 and above a top of the plurality of first gas ports 114.

The first extension 126 may extend toward the outlet port 108. According to exemplary embodiments, the first edge 128 of the first extension 126 may extend in the lateral direction (e.g., parallel to the burner 112). Accordingly, the second edge 130 of the first extension 126 may extend in the lateral direction, parallel to the first edge 128. The second edge 130 of the first extension 126 may be located within the virtual boundary 110 of the outlet port 108. For example, the second edge 130 of the first extension 126 may be located under the outlet port 108 (e.g., behind the front plane of the virtual boundary 110). Additionally or alternatively, the second edge 130 of the first extension 126 may be located above the second horizontal plane $P_2$.

Additionally or alternatively, the second edge 130 of the first extension 126 may be located above an apex of the convex side 132 of the cover portion 124. In some embodiments, the second edge 130 of the first extension 126 may be located at a position greater than about 50% of a height $H_1$ between the top of the burner 112 and a bottom of the bottom wall 102. The first extension 126 may extend from the cover portion 124 at a first angle $\Theta_1$ with respect to the vertical direction V. For example, the first angle $\Theta_1$ between the vertical axis and the first extension 126 may be between 10 degrees and 40 degrees. For another example, the angle between the vertical axis and the first extension 126 may be between 15 degrees and 35 degrees. For another example, the angle between the vertical axis and the first extension 126 may be between 15 degrees and 20 degrees. The first angle $\Theta_1$ may be measured between a top surface of the first extension 126 and the vertical axis. Accordingly, the first edge 128 of the first extension 126 may be located outside of the virtual boundary 110 while the second edge 130 of the first extension 126 is located within the virtual boundary 110.

The burner shield 120 may further include a second extension 136 extending from the cover portion 124. The second extension 136 may include a first edge 138 connected to the cover portion 124 and a second edge 140 opposite the first edge 138. The second extension 136 may extend from an opposite side of the cover portion 124 than the first extension 126. For example, the second extension 136 may extend toward the vertical center line 118 of the bottom plate 102. In some embodiments, the second edge 140 of the second extension 136 may be connected to the bottom wall 102. In some embodiments the second extension 136 may be connected to a side wall of the oven cavity 100. In alternate embodiments, the second extension 136 may be connected to a bottom of the oven cavity 100.

The second extension 136 may extend from the cover portion 124 at an angle with respect to the vertical direction V. For example, a second angle $\Theta_2$ between the vertical axis and the second extension 136 may be between 45 degrees and 80 degrees. For another example, the second angle $\Theta_2$ between the vertical axis and the second extension 136 may be between 60 degrees and 80 degrees. For another example, the second angle $\Theta_2$ between the vertical axis and the second extension 136 may be between 70 degrees and 75 degrees. The second angle $\Theta_2$ may be measured between a top surface of the second extension 136 and the vertical axis.

Advantageously, the burner shield 120 may protect the burner 112, and specifically the first gas ports 114 and second gas ports 116 from becoming clogged and malfunctioning due to grease or contamination from the cooking chamber 104 passing through the outlet port 108 and onto the burner 112. Additionally or alternatively, the burner shield 120 may allow the burner 112 to be positioned close to the outlet port 108 in order to more efficiently heat the cooking chamber 104. Additionally or alternatively, the second extension 136 may assist in directing heat from the second gas ports 116 toward a center of the bottom wall 102.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly of an oven appliance comprising a bottom wall and an outlet port defined in the bottom wall, the burner assembly comprising:

a burner positioned below the bottom wall proximate the outlet port and outside of a virtual boundary of the outlet port that extends in a vertical direction, wherein the burner comprises a plurality of first gas ports facing a rear of the oven appliance in the transverse direction and a plurality of second gas ports facing a front of the oven appliance in the transverse direction, and wherein a length between the plurality of first gas ports and a front edge of the virtual boundary of the outlet port in the transverse direction is shorter than a length between the plurality of second gas ports and a vertical center line of the bottom wall in the transverse direction; and a burner shield comprising:

a cover portion positioned directly over the burner; and a first extension having a first edge connected to the cover portion and a second edge opposite the first edge, wherein the first extension extends toward the outlet port.

2. The burner assembly of claim 1, wherein the cover portion is curved such that a convex side of the cover portion faces the bottom wall and the burner is provided under a concave side of the cover portion.

3. The burner assembly of claim 2, wherein the burner shield further comprises a second extension having a first edge connected to the cover portion and a second edge connected to the bottom wall, and wherein the second extension extends from the bottom wall at a first predetermined angle with respect to the vertical direction.

4. The burner assembly of claim 3, wherein the second edge of the first extension is located higher than an apex of the convex side of the cover portion.

5. The burner assembly of claim 3, wherein the burner extends in the lateral direction, and wherein a junction between the first extension and the cover portion is in a horizontal plane below a top of the burner and above a top of the plurality of gas ports.

6. The burner assembly of claim 5, wherein the first extension extends from the cover portion at a second predetermined angle with respect to the vertical direction.

7. The burner assembly of claim 6, wherein the plurality of first gas ports is greater than the plurality of second gas ports.

8. The burner assembly of claim 1, wherein the burner is spaced apart from a front edge of the virtual boundary of the outlet port by a distance in the transverse direction that is shorter than a width of the outlet port in the transverse direction.

9. The burner assembly of claim 1, wherein the first extension extends at least partially into the virtual boundary of the outlet port.

10. An oven appliance defining a vertical direction, lateral direction, and transverse direction, the oven appliance comprising:

a cooking chamber defined at least in part by a bottom wall having an outlet port defined therein, wherein the outlet port defines a virtual boundary projected in the vertical direction;

a burner positioned below the bottom wall proximate the outlet port and outside of the virtual boundary of the outlet port, wherein the burner is spaced apart from a front edge of the virtual boundary of the outlet port by a distance in the transverse direction that is shorter than a width of the outlet port in the transverse direction; and a burner shield comprising:

a cover portion positioned directly over the burner; and a first extension having a first edge connected to the cover portion and a second edge opposite the first edge, wherein the first extension extends toward the outlet port.

11. The oven appliance of claim 10, wherein the cover portion is curved such that a convex side of the cover portion faces the bottom wall and the burner is provided under a concave side of the cover portion.

12. The oven appliance of claim 11, wherein the burner shield further comprises a second extension having a first edge connected to the cover portion and a second edge connected to the bottom wall, and wherein the second extension extends from the bottom wall at a first predetermined angle with respect to the vertical direction.

13. The oven appliance of claim 12, wherein the second edge of the first extension is located higher than an apex of the convex side of the cover portion.

14. The oven appliance of claim 12, wherein the burner extends in the lateral direction and comprises a plurality of first gas ports facing a rear of the oven appliance in the transverse direction, and wherein a junction between the first extension and the cover portion is in a horizontal plane below a top of the burner and above a top of the plurality of gas ports.

15. The oven appliance of claim 14, wherein the burner further comprises a plurality of second gas ports facing a front of the oven appliance in the transverse direction, and wherein the first extension extends from the cover portion at a second predetermined angle with respect to the vertical direction.

16. The oven appliance of claim 15, wherein a length between the plurality of first gas ports and a front edge of the virtual boundary of the outlet port in the transverse direction is shorter than a length between the plurality of second gas ports and a vertical center line of the bottom wall in the transverse direction.

17. The oven appliance of claim 10, wherein the first extension extends at least partially into the virtual boundary of the outlet port.

* * * * *